US005642883A

United States Patent [19]

Rioux

[11] Patent Number: 5,642,883

[45] Date of Patent: Jul. 1, 1997

[54] PUZZLE HOLDER

[75] Inventor: Marcel Rioux, Piedmont, Canada

[73] Assignee: Madisco Inc., Ste-Adele, Canada

[21] Appl. No.: 602,875

[22] Filed: Feb. 6, 1996

[51] Int. Cl.[6] ..... A63F 9/10

[52] U.S. Cl. ..... 273/157 R; 273/148 R; 273/DIG. 30

[58] Field of Search ..... 273/157 R, 309, 273/148 R, DIG. 30; 108/115; 269/329

[56] References Cited

U.S. PATENT DOCUMENTS

| | | | |
|---|---|---|---|
| 1,987,496 | 1/1935 | Springborn | 273/157 R |
| 3,504,915 | 4/1970 | Walker | 273/157 R |
| 3,792,668 | 2/1974 | Ward | 273/157 R X |
| 4,436,307 | 3/1984 | Caldwell | 273/157 R |
| 4,479,651 | 10/1984 | LaFleur | 273/157 R |
| 4,484,745 | 11/1984 | Sleeper | 273/157 R |
| 4,552,361 | 11/1985 | LaFleur | 273/157 R |
| 4,865,325 | 9/1989 | Stolz | 273/157 R |
| 5,219,168 | 6/1993 | Morris | 273/157 R |
| 5,538,248 | 7/1996 | Shillito et al. | 273/157 R |

FOREIGN PATENT DOCUMENTS

| | | | |
|---|---|---|---|
| 1181232 | 2/1970 | United Kingdom | 273/157 R |
| 2056865 | 3/1981 | United Kingdom | 273/157 R |
| 2173708 | 10/1986 | United Kingdom | 273/157 R |

*Primary Examiner*—Raleigh W. Chiu
*Attorney, Agent, or Firm*—François Martineau

[57] ABSTRACT

This jig-saw puzzle holder comprises two co-extensive work panels hinged together at their inner edges to take a closed folded position and an open coplanar position with their inner edges forming a smooth joint. A liner sheet covers and is secured to the panels and serves as a work surface upon which puzzle pieces can be assembled. To each panel is associated a generally co-extensive flexible cover sheet to cover puzzle pieces on the liner sheet. The liner and cover sheets are hook-and-loop fastener fabric so that the cover sheets can adhere to the liner sheet to surround the partially assembled puzzle pieces and thus prevent shifting of these pieces. When the pieces are being assembled, the cover sheet is rolled up and retained in an out-of-the-way position. Each panel is provided with a drawer to store individual puzzle pieces. Each panel is used to assemble half of the completed puzzle and the two halves are assembled across the smooth joint of the two open coplanar panels. A foldable support serves to maintain in a viewing position the picture of the completed puzzle on the cover of the puzzle container box. Latches releasably retain the panels and drawers in closed position. The outer portions of the panels form a handle for conveniently carrying the folded holder.

16 Claims, 4 Drawing Sheets

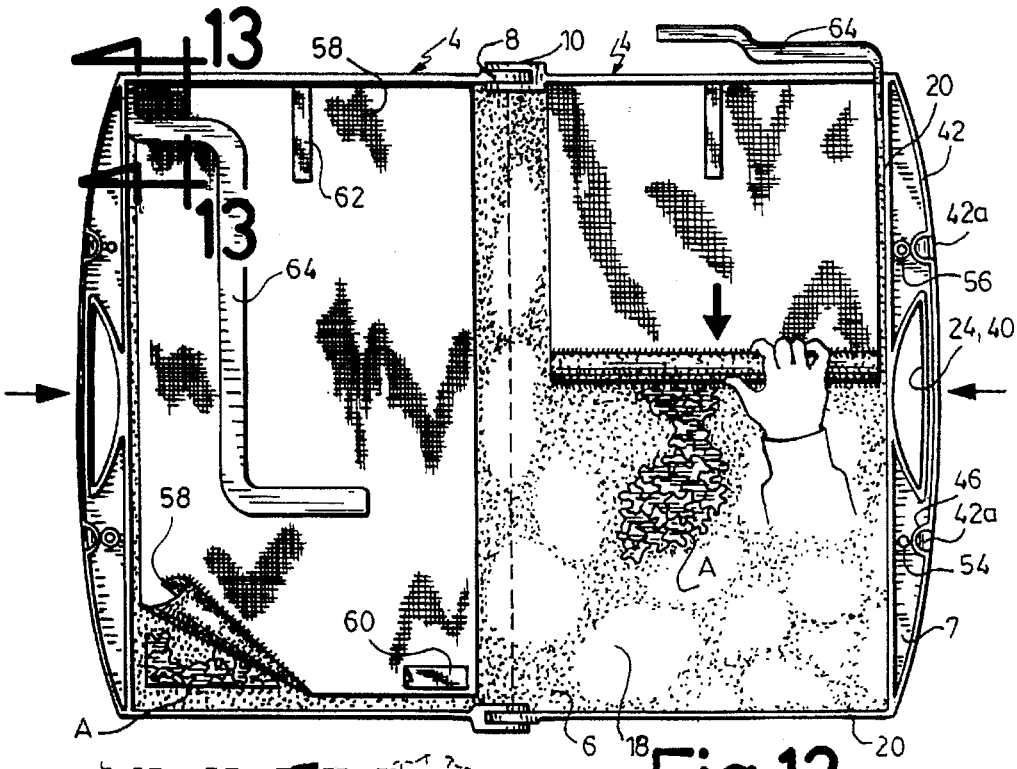
Fig.12
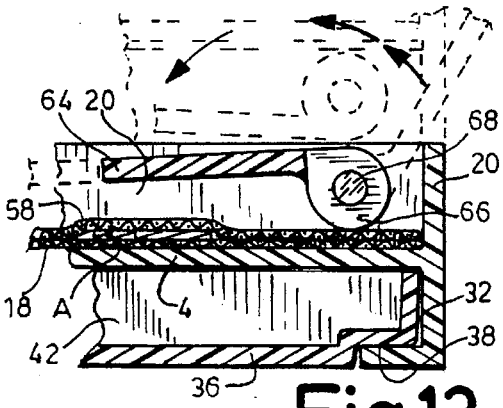
Fig.13
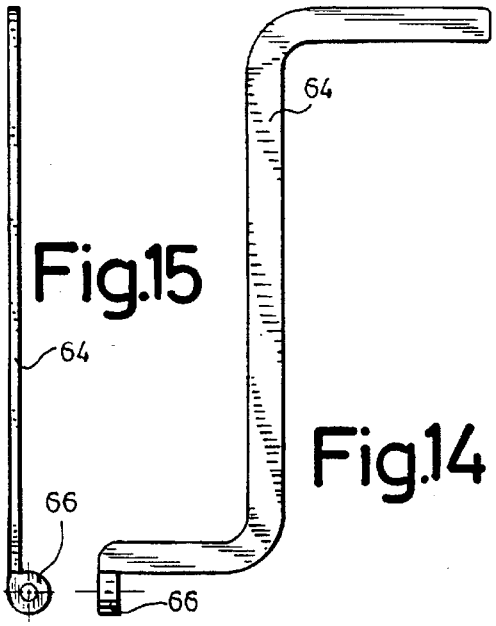
Fig.15
Fig.14
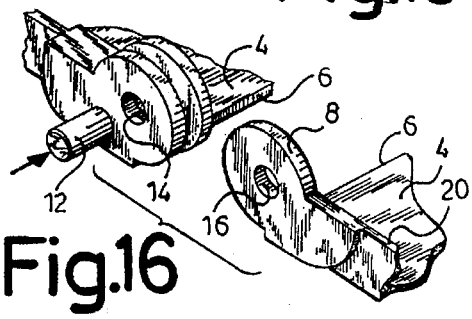
Fig.16

PUZZLE HOLDER

FIELD OF THE INVENTION

This invention relates to a holder for assembling the pieces of a jig-saw puzzle and for storing the pieces before final puzzle assembly.

BACKGROUND OF THE INVENTION

Several types of holders are already known to provide work panels upon which puzzle pieces can be assembled and to provide means for constraining such pieces in predetermined positions for storage before completion of the puzzle. These holders are useful since it very often occurs that a puzzle cannot be completely assembled without interruption and in fact, work on a single puzzle, may extend over periods of several days or weeks. Since the pieces of a partially assembled puzzle cannot be disturbed throughout these periods, it is generally the practice to let the puzzle occupy a table or other work surface supporting the same until it is completed, this can create inconvenience.

U.S. Pat. No. 4,484,745 dated Nov. 27, 1984 and entitled JIG-SAW PUZZLE ASSEMBLY AND STORAGE APPARATUS, inventor John R. SLEEPER describes a work panel on which the puzzle pieces are assembled. This panel is made of wood or plastic and covered by a thin layer of tin or steel constituting a ferromagnetic base. A flexible magnetic cover sheet is hinged to one edge of the work panel and adheres to the thin layer of tin or steel all around the puzzle pieces to hold them in a desired relationship and against shifting during horizontal or vertical storage of the panel. The work panel of this holder is in the form of a table top and is provided with foldable legs. This holder, when made of a size to accommodate puzzles containing a great number of pieces, is too big to be conveniently carried, so much so because the required size must be larger than that of the assembled puzzle to provide extra room to lay out individual pieces to be assembled.

OBJECTS OF THE INVENTION

It is therefore the general object of the present invention to provide a jig-saw puzzle holder of the character described which, when in puzzle pieces storing condition is of a size which is smaller than the size of the puzzle to be assembled so that the holder can be put away in a minimum of room and be conveniently carried.

Another object of the present invention resides in the provision of a jig-saw puzzle holder of the character described which is of light weight and inexpensive construction.

SUMMARY OF THE INVENTION

The jig-saw puzzle holder of the invention comprises two substantially co-extensive work panels, an interior and an exterior surface, a liner sheet covering and secured to the interior surfaces of both panels for supporting individual pieces as they are assembled thereon, two flexible cover sheets, each associated with one panel and substantially co-extensive therewith, said cover sheets releasably adhering to said liner sheet upon application of pressure on said cover sheets against said liner sheet so that said cover sheets cover and engage pieces of a partially assembled puzzle resting on said liner sheet, the portions of said cover sheets surrounding said pieces directly adhering to said liner sheet and holding said pieces in position against shifting and wherein each of said two panels have an inner and an outer edge, and further including hinge means hinging said panels to each other about their inner edges, said panels foldable about said hinge means to enclose said liner and cover sheets and for enclosing pieces held between the same, from a substantially coplanar open position wherein the two panels and said liner sheet form a smooth joint to permit shifting across said joint partially assembled or individual puzzle pieces.

Preferably, drawer slides are carried by at least one of the work panels and protrude from the outside thereof being normal to the hinge axis and a drawer is slidably retained by the slides for slidable opening movement from a closed position facing said panel, said drawer used for storing individual puzzle pieces and for rendering the same accessible to the user when the drawer is opened.

Preferably, each work panel is fitted with its own drawer.

Preferably, drawer and work panel latching means are provided for latching the drawer in closed position and for latching the work panels in folded position.

Preferably, the liner and the cover sheets are hook-and-loop fastener fabrics, the liner sheet preferably being the loop fabric and the cover sheets being the hook fabrics.

Preferably, each cover sheet can be wound upon itself to uncover the liner sheet and to form a roll disposed at one end of the liner sheet, therebeing provided a roll retaining band secured to the liner and releasably surrounding and retaining said roll against unwinding.

Preferably, panel handle portions are formed at the outer edge of each panel and mutually register in the folded closed position of the panels to form a holder carrying handle.

Preferably, the drawer has internal ribs forming drawer compartments to separately store puzzle pieces classified as to shape and/or colour.

Preferably, the drawer has an inner and an outer edge and two side edges and a peripheral side wall protruding from said edges of said drawer towards said panel, said outer edge and said side wall of said drawer forming a central recess registering with said handle in the closed position of said drawer.

Preferably, the outer edges of said panels form drawer exposing recesses which are in register when said two panels are in folded position and further including drawer side wall portions bordering said drawer exposing recesses of said drawer in the closed position of said drawer.

Preferably, there is a drawer abutment wall parallel to and adjacent said inner edge of said panel and protruding from said exterior surface of said panel, and said drawer latching means includes a button protruding from said abutment wall and frictionally engaging within a hole made in said side wall of said drawer when the latter is in closed position.

Preferably, each panel has side edges parallel to said drawer slides and further includes a panel side wall protruding from said interior surface of said panel along said panel side edges and said panel outer edge and abutting the panel side wall of the other panel in the folded position of said panels, said liner sheet being common to both said panels and having a portion parallel to and on each side of said joint which is not secured to the interior surfaces of said panels so as to bridge said interior surfaces in the folded position of said panels, said liner sheet extending over and across said joint in the coplanar open position of said panels.

Preferably, puzzle picture holding bars are pivoted to an outer corner of said panels for movement between a stored position overlying said cover sheets and a limit upwardly inclined position to exhibit to the user the picture of the completed puzzle on the cover of the puzzle container box.

BRIEF DESCRIPTION OF THE DRAWING

FIG. 12 is a top plan view of the unfolded work panels similar to that of FIG. 10 but with the drawers fully closed and one cover sheet practically completely unwound in covering position and the other cover sheet being unwound; and FIG. 13 is a partial section taken along line 13—13 of FIG. 12;

FIGS. 14 and 15 are right angular elevations of one picture holding bar; and FIG. 16 is an exploded partial perspective view of one of the hinges of the holder.

DETAILED DESCRIPTION OF THE PREFERRED EMBODIMENT

Figure 1:
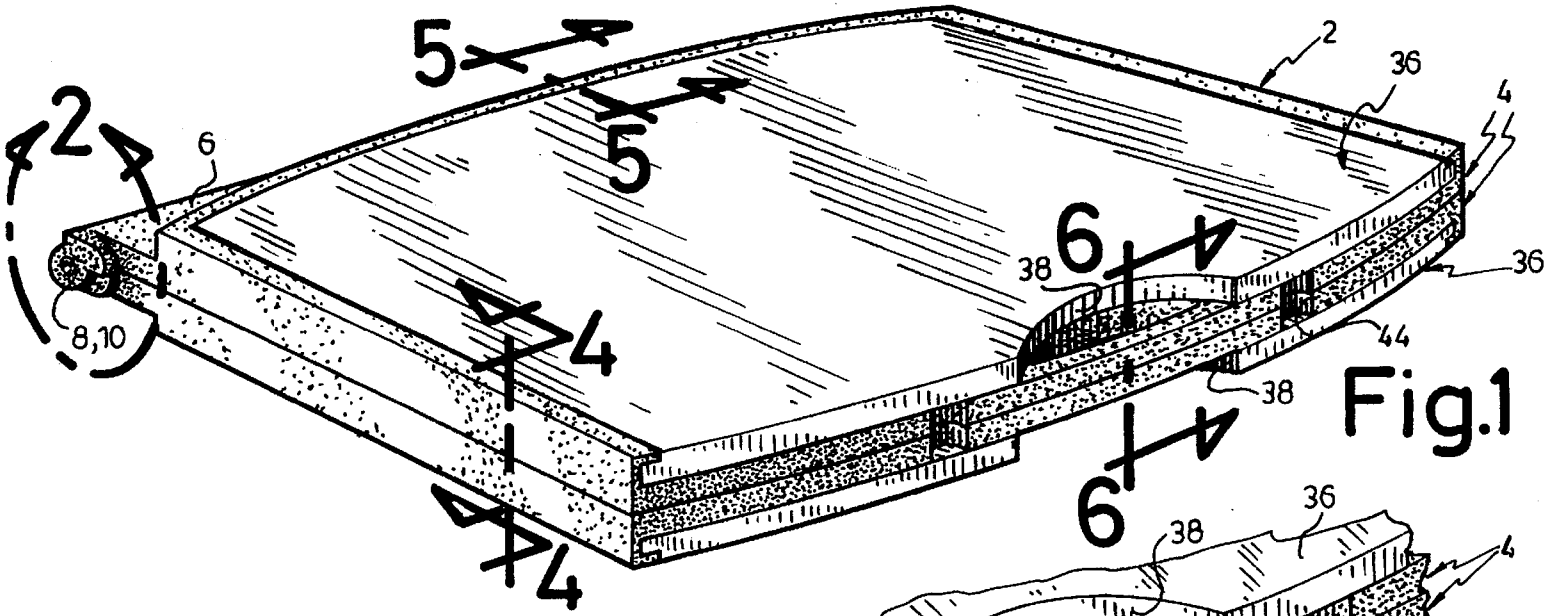
FIG. 1 is a perspective view of the puzzle holder in folded position.
Figure 2:
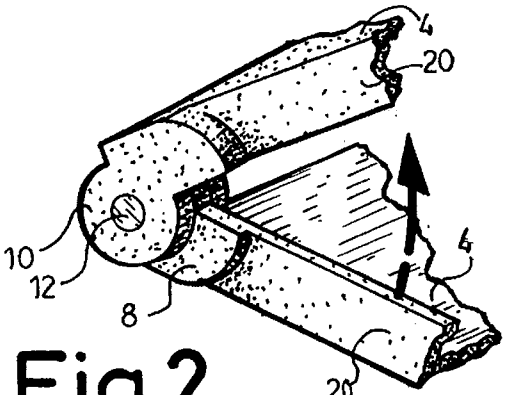
FIG. 2 is a partial view of one hinge of the holder with the two panels partially opened, FIG. 2 being taken in area 2 of FIG. 1.

The jig-saw puzzle holder 2 of the present invention comprises two identical, co-extensive, molded work panels 4, of plastic material, each having an inner edge 6 and an outer portion 7, the two panels being hinged to each other along an axis parallel to their edges 6 by means of a male hinge part 8 rotatably inserted within a female hinge part 10 and retained by a hinge pin 12 frictionally inserted into holes 14 20 and 16 of the hinge parts 10 and 12 respectively (see FIGS. 2, 10, 11 and 12 respectively).

To permit the use of one mold for molding the two panels 4, the position of the hinge parts 8 and 10 on one panel of the holder is reversed relative to the other panel.

Figures 9, 10, 11:
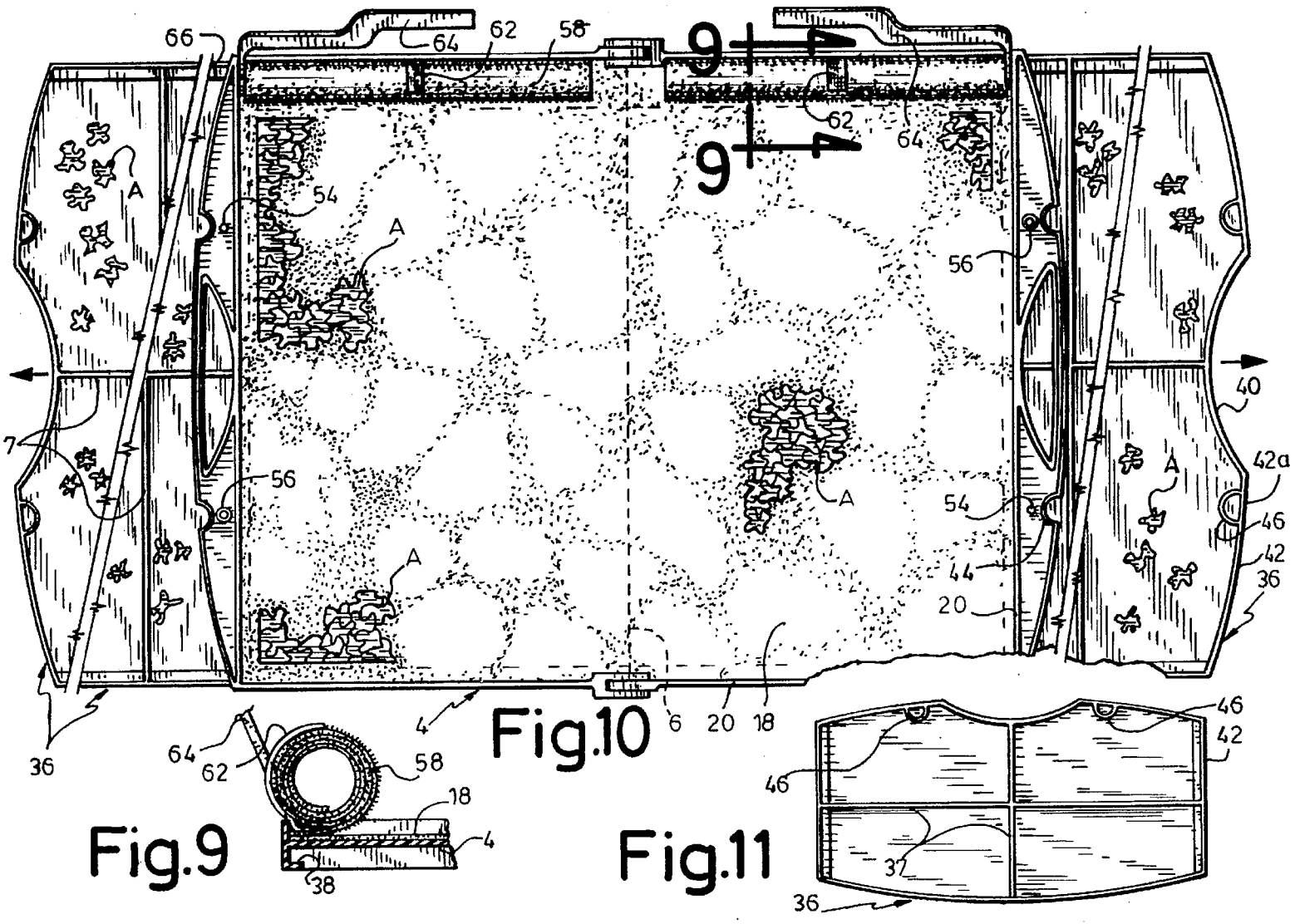
FIG. 9 is a cross-section taken along line 9—9 of FIG. 10 and showing the cover sheet in rolled up position.
FIG. 10 is a top plan view of the holder in unfolded position to work puzzle pieces thereon, the picture holding bars in operative position and the drawers being partially opened.
FIG. 11 is a top plan view of a drawer.

Each work panel 4 defines an inner work surface covered by a flexible liner sheet 18 which adheres to the two inner surfaces of the two panels, said liner sheet being preferably a single sheet which covers both work panels as shown in FIG. 10.

Liner sheet 18 is preferably a fabric constituting one part of a hook-and-loop fastener such as the fastener known under the trade mark Velcro. More particularly sheet 18 is the loop fabric part of the fasterner. Liner sheet 18 is bordered by a peripheral wall 20 extending along the sides of the work panels 4 and inwardly of outer portion 7. Inner edges 6 do not have a wall 20.

To make it stronger, male part 8 of each hinge is about double the thickness of wall 20 from which it extends. Both hinge parts 8 and 10 protrude from inner edges 6 of panels 4.

Figure 4:
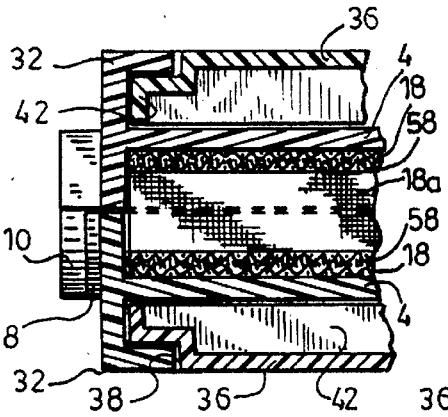
FIGS. 4, 5 and 6 are partial sections taken along lines 4—4, 5—5 and 6—6 respectively of FIG. 1.
Figure 6:
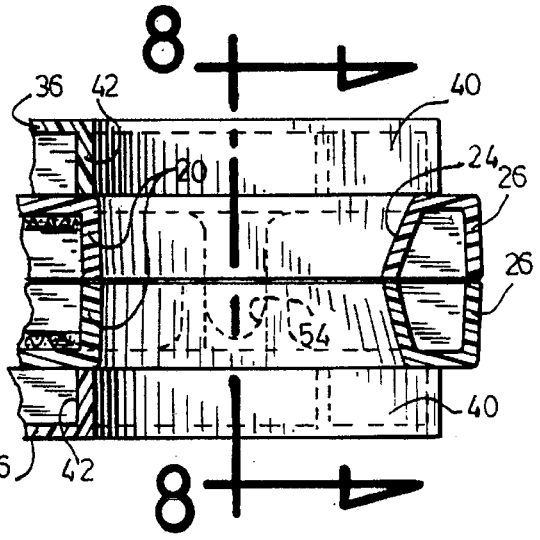
Figure 5:
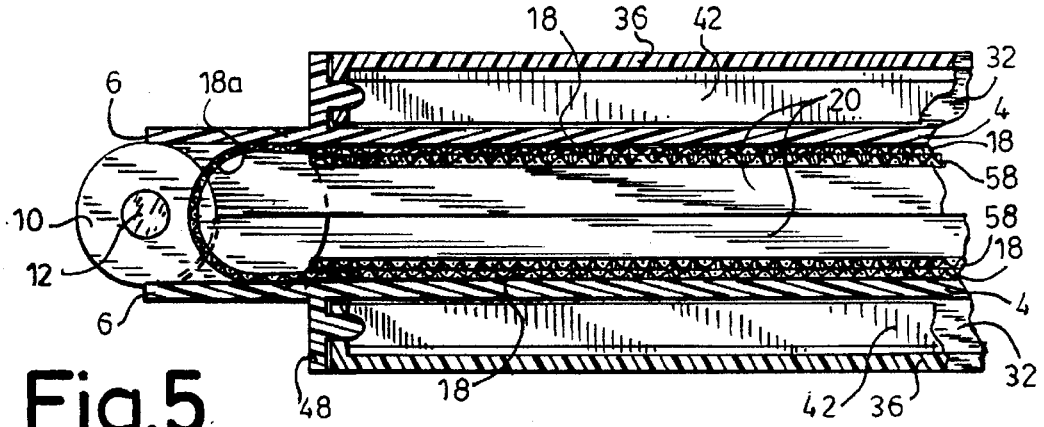
Figure 7:
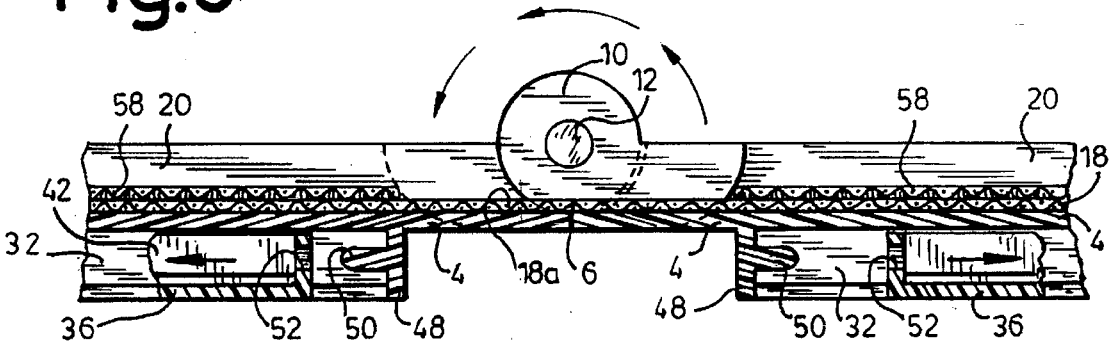
FIG. 7 is a partial longitudinal section, similar to that of FIG. 5, but showing the two work panels in unfolded, coplanar position, showing also each drawer partially opened.
Figure 8:
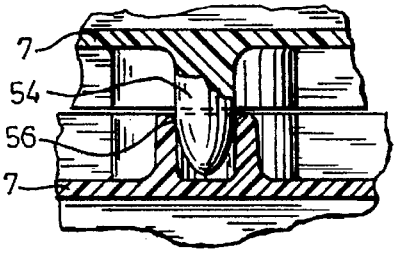
FIG. 8 is a cross-section taken along line 8—8 of FIG. 6 and showing the latching means to maintain the two panels in closed position.

The two work panels are pivotable about hinges 8, 10 between a fully closed position as shown in FIGS. 1, 4, 5 and 6 in which the two walls 20 are in mutual abutment and a fully opened operative position as shown in FIGS. 7, 10 and 11 wherein the two work panels 2 and 4 are coplanar and their inner edges 6 are in contact and form a smooth joint covered by a flat central portion 18*a* of the liner sheet 18. It is noted that this central portion 18*a*, in the area of the inner edges 6, does not adhere to the work panels as shown in FIGS. 8 and 5, so as to bridge and enable folding of the two work panels.

The two outer portions 7 are substantially identical and each defines a hand insertable opening 24; both openings 24 register with each other when the two work panels 4 are in folded position. Each hand insertable opening 24 is outwardly bounded by a reinforcing U-shaped flange 26. The two openings 24 are disposed centrally of the work panels 4 and each outer portion 7 further includes a border wall 28 which is generally convex when shown in top view and forms a continuation of the U-shaped outer flange 26 of the handle opening 24.

A reinforcing wall 30 borders the edge portions of the hand insertable opening 24 which are not already bordered by U-shaped flange 26. Each work panel 4 forms a pair of drawers slides 32 which protrude from the outer face of each panel 4 and are disposed along the side edges of the same in mutual register with walls 20, drawer slides 22 being normal to the hinge axis of the holder.

Each drawer slide 32 is of L-shaped section as shown in FIG. 4 and is designed to slidably hold a drawer 36 which is relatively shallow, its side edges forming a recess 38 for receiving the inner flange of the L-shaped drawer slides 32. Each drawer 36 is designed to store individual puzzle pieces A without flipping and has intersecting ribs 37 forming drawer compartments for holding pieces A classified as to shape and/or colour (see FIG. 11).

Each drawer has at its outer end a central recess 40 for clearing the hand insertable opening 24 when the drawers are in fully closed position (as shown in FIGS. 1 and 12).

Figure 3:
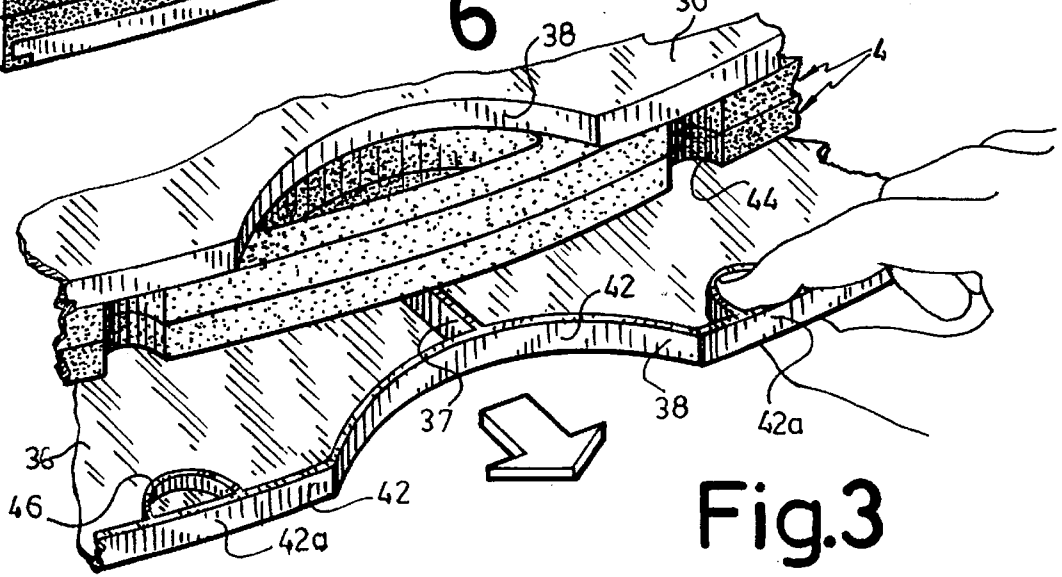
FIG. 3 is a partial perspective view of the handle portion of the partially folded holder showing one drawer partially opened.

Each drawer 36 has a peripheral wall 42 and the portions 42*a* of this wall on each side of the central recess 40 serve to grip the drawer for pulling the same open (as shown in FIG. 3), these wall portions 42*a* being exposed within registering recesses 44 formed at the outer edge of the work panels 4.

Preferably, flange portions 42*a* are delimited by a curved flange 46. A drawer stop flange 48 extends between the two drawer slides 32 near the inner edges 6 of the work panels 4, said drawer stop flange 48 being parallel to the inner edge 6 and to the hinge axis. Latching means are provided to retain the drawer in closed position; for instance, a cylindrical button 50 protrudes inwardly from the drawer stop flange 48 to frictionally engage a registering hole 52 made in the inner portion of the peripheral flange 42 of the drawer.

Similarly, latching means are provided to releasably maintain the two work panels 4 in closed position. These latching means, shown in FIGS. 6 and 8, preferably include a cylindrical button 54 inwardly protruding from outer portion 7 of one work panel 4 and engageable with a registering collar 56 inwardly protruding from the outer portion 7 of the opposite work panel.

Preferably, two latching systems 54, 56 are provided on both sides of the central hand insertable openings 24, being integrally moulded with one button 54 and one collar 56 to enable the use of a single mould to mould both work panels 4.

As noted above, liner sheet 18 is a loop fabric to provide a felt-like smooth surface on which the separate, conventional, puzzle pieces A can be assembled (as shown in FIG. 10).

Each work panel 4 is provided with its own flexible cover sheet 58 formed by a hook fabric constituting the other part of hook-and-loop fastener. Each flexible cover sheet 58 is substantially co-extensive with a work panel 4 being secured at one end to liner 18 along one side of peripheral wall 20. Each cover sheet 58 can be wound upon itself to form a roll (as shown in FIG. 10) and each roll can be fully unwound (as shown in FIG. 12) and by pressing the same against panel 4 will grip liner sheet 18 to retain puzzle pieces A between sheets 18 and 58 as shown in FIG. 13. Cover sheet 58 is provided with a tongue 60 near its outer end which can be gripped to pull and detach cover sheet 58 from the liner sheet 18. When the cover sheet 58 is fully wound, it is maintained against unwinding by a band 62 made of loop fabric and hook fabric of cover sheet 58 attached at the male Velcro cover sheet 66 (as shown in FIG. 9).

A pair of puzzle picture holding bars 64 are provided. Each bar 64 has a Z shape (see FIG. 14) and is terminated at its inner end by a right angle eye 66.

Bars 64 are pivoted to panel peripheral wall 20 by a pin 68 (see FIG. 13) at the two outer corners of panels 4 which are aligned with the cover sheet rolls.

Bars 64 can be swung between a stored position (FIG. 13 and left hand side of FIG. 12) resting on the unwound cover sheet 58 and an operative, upwardly, outwardly inclined limit position in which it abuts against wall 20 (dotted line position in FIG. 13 and right hand side of FIG. 12).

In operative position, the two bars 64 can hold the puzzle containing box cover in a convenient position for the user to view the picture of the completed puzzle on said box cover. Bars 64, in stored position, permit folding of panels 4.

The right angular inner end portions of bars 64 (FIG. 14) enable the two bars to hold a box cover of a smaller size than the size of the two coplanar panels 4.

The holder of the invention is used as follows: individual puzzle pieces A can be stored in detached condition in the drawers 36. At the start of a work session, the two work panels 4 and drawers 36 are fully opened and the two cover sheets rolled up. The stored bars 64 are pivoted to their operative position and the box cover hung on the same. One can first classify puzzle pieces A by shape and/or colour using the drawer compartments formed by ribs 37. The classified pieces A are transferred on liner sheet 18 and assembled. The partially assembled puzzle pieces, at the end of a working session, are kept in position and against shifting relative to liner sheet 18 by unrolling the cover sheet 66 and adhering the same to the liner sheet 18 by simple hand pressure all around the puzzle pieces to form pockets constraining said pieces A. When puzzle border pieces Aa are assembled (as shown on left hand side of FIG. 10) care should be taken to leave exposed a marginal portion 18*a* of the liner sheet 18 to which the border of cover sheet 58 may adhere.

In practice, the puzzle pieces are assembled as two separate parts: one on each work panel 4 so as to permit folding of the two work panels 4 at the end of a working session. At the final working session, the two puzzle halves are simply assembled together by relative shifting of the same on liner 18 across the smooth joint formed at the inner edge 6 of the work panels 4.

At the end of each work session, the two drawers 36 are pushed in and latched into retracted position by the latching system 50, 52 and similarly the two work panels 4 are maintained in folded position by the latching system comprising the buttons 54 and collars 56. The folded holder can be conveniently carried by its handle. Ribs 37 of closed drawers 36 maintain the puzzle pieces which they still contain in already classified position.

As noted above, all the parts except the liner 18 and cover sheet 58, tongue 60 and retaining bands 62 are made of moulded plastic material for minimum weight and cost.

Due to the fact that both work panels 4 can be used for assembly of the puzzle pieces and that the drawers used to store the unassembled puzzle pieces lie within the confines of the respective work panels 4 in retracted closed position, it is obvious that the holder of the invention can accommodate a jig-saw puzzle of a size nearly twice the size of the folded holder.

I claim:

1. A jig-saw puzzle holder for puzzles having a number of pieces to be assembled, comprising two substantially co-extensive work panels, each having an interior and an exterior surface, a liner sheet covering and secured to the interior surfaces of both panels for supporting individual pieces as they are assembled thereon, two flexible cover sheets, each associated with one panel and substantially co-extensive therewith, said cover sheets releasably adhering to said liner sheet upon application of pressure on said cover sheets against said liner sheet so that said cover sheets cover and engage pieces of a partially assembled puzzle resting on said liner sheet, the portions of said cover sheets surrounding said pieces directly adhering to said liner sheet and holding said pieces in position against shifting and wherein each of said two panels have an inner and an outer edge, and further including hinge means hinging said panels to each other about their inner edges, said panels foldable about said hinge means to enclose said liner and cover sheets and for enclosing pieces held between the same, from a substantially coplanar open position wherein the two panels and said liner sheet form a smooth joint to permit shifting across said joint partially assembled or individual puzzle pieces.

2. A jig-saw puzzle holder as defined in claim 1, further including a pair of drawer slides carried by at least one of said panels, protruding from the exterior surface thereof and normal to the hinge axis of said hinge means, and a drawer slidably retained by said slides for opening movement from a closed position facing said panel, said drawer adapted to store individual puzzle pieces which become accessible to the user when the drawer is opened.

3. A jig-saw puzzle holder as defined in claim 2, wherein there is a pair of drawer slides and a drawer associated with each panel.

4. A jig-saw puzzle holder as defined in claim 2, further including drawer latching means for releasably latching said drawer in closed position.

5. A jig-saw puzzle holder as defined in claim 4, further including panel latching means for releasably latching said panels in folded position.

6. A jig-saw puzzle holder as defined in claim 2, wherein said liner and cover sheets are fabrics constituting hook-and-loop fasteners.

7. A jig-saw puzzle holder as defined in claim 6, wherein said liner sheet is a loop fabric and said cover sheets are hook fabrics.

8. A jig-saw puzzle holder as defined in claim 2, wherein said cover sheet can be wound to cover said liner sheet and form a roll disposed at one end of said liner sheet, and further including roll retaining bands secured to said liner sheet and releasably surrounding and retaining said roll against unwinding.

9. A jig-saw puzzle holder as defined in claim 2, further including panel handle portions at said outer edge and centrally of each panel, said handle portions mutually registering in the folded position of said panels to form a complete central handle for carrying the folded holder.

10. A jig-saw puzzle holder as defined in claim 9, where said drawer has an inner and an outer edge and two side edges and a peripheral side wall protruding from said edges of said drawer towards said panel, said outer edge and said side wall of said drawer forming a central recess registering with said handle in the closed position of said drawer.

11. A jig-saw puzzle holder as defined in claim 10, wherein said outer edges of said panels form drawer exposing recesses which are in register when said two panels are in folded position and further including drawer side wall portions bordering said drawer exposing recesses of said drawer in the closed position of said drawer.

12. A jig-saw puzzle holder as defined in claim 10, further including a drawer abutment wall parallel to and adjacent said inner edge of said panel and protruding from said exterior surface of said panel, and a button protruding from said abutment wall and frictionally engaging within a hole made in said side wall of said drawer when the latter is in closed position.

13. A jig-saw puzzle holder as defined in claim 2, wherein each panel is moulded in one piece out of plastic material and further including panel latching means for releasably latching said panels in closed position, said panel latching means including buttons integrally moulded with one panel and protruding towards the other panel and collars made in the other panel and registering and frictionally receiving said buttons when said panels are in folded position.

14. A jig-saw puzzle holder as defined in claim 2, wherein said drawer has internal ribs forming drawer compartments to separately store puzzle pieces classified as to shape and/or colour.

15. A jig-saw puzzle holder as defined in claim 2, wherein each panel has side edges parallel to said drawer slides and further including a panel side wall protruding from said interior surface of said panel along said panel side edges and said panel outer edge and abutting the panel side wall of the other panel in the folded position of said panels, said liner sheet being common to both said panels and having a portion parallel to and on each side of said joint which is not secured to the interior surfaces of said panels so as to bridge said interior surfaces in the folded position of said panels, said liner sheet extending over and across said joint in the coplanar open position of said panels.

16. A jig-saw puzzle holder as defined in claim 2, further including puzzle picture holding bars pivoted to an outer corner of said panels for movement between a stored position overlying said cover sheets and a limit upwardly inclined position to exhibit to the user the picture of the completed puzzle on the cover of the puzzle container box.

* * * * *